US008627635B1

(12) United States Patent
Armstrong

(10) Patent No.: US 8,627,635 B1
(45) Date of Patent: Jan. 14, 2014

(54) GRID PANEL

(71) Applicant: Charles M. Armstrong, Nacogdoches, TX (US)

(72) Inventor: Charles M. Armstrong, Nacogdoches, TX (US)

( * ) Notice: Subject to any disclaimer, the term of this patent is extended or adjusted under 35 U.S.C. 154(b) by 0 days.

(21) Appl. No.: 13/721,181

(22) Filed: Dec. 20, 2012

(51) Int. Cl.
*E04C 2/42* (2006.01)
*B01F 3/04* (2006.01)

(52) U.S. Cl.
USPC ..... 52/669; 52/664; 52/799.12; 261/111

(58) Field of Classification Search
USPC ..... 52/663, 664, 669, 673, 799.12; 428/134; 211/187, 190, 134, 90.03, 211/133.5, 133.2; 261/111, DIG. 11; 210/163, 164, 498, 499; 119/527, 530
See application file for complete search history.

(56) References Cited

U.S. PATENT DOCUMENTS

| | | | | | |
|---|---|---|---|---|---|
| 320,567 | A | * | 6/1885 | Lord | 52/388 |
| 1,988,728 | A | * | 1/1935 | Green | 52/668 |
| 2,607,455 | A | * | 8/1952 | Yellin | 52/664 |
| 2,760,650 | A | * | 8/1956 | Franks | 211/187 |
| 2,770,336 | A | * | 11/1956 | Gingo et al. | 52/581 |
| 2,899,775 | A | * | 8/1959 | Partin | 47/1.01 R |
| 3,039,749 | A | * | 6/1962 | Kohl et al. | 261/112.1 |
| 3,189,335 | A | * | 6/1965 | Fuller et al. | 261/112.1 |
| 3,645,510 | A | * | 2/1972 | Klugman | 261/94 |
| 3,751,017 | A | | 8/1973 | Lemmens | |
| 4,062,995 | A | * | 12/1977 | Korpman | 428/134 |
| 4,167,599 | A | * | 9/1979 | Nissinen | 428/44 |
| 4,381,326 | A | * | 4/1983 | Kelly | 428/134 |
| 4,457,878 | A | | 7/1984 | Meytsar | |
| 4,590,731 | A | * | 5/1986 | DeGooyer | 52/581 |
| 4,930,286 | A | * | 6/1990 | Kotler | 52/177 |
| 4,996,008 | A | | 2/1991 | Peterson | |
| 5,017,309 | A | | 5/1991 | Peterson | |
| 5,104,588 | A | | 4/1992 | Kinney, Jr. | |
| D332,509 | S | * | 1/1993 | Kovatch | D30/120 |
| 5,326,503 | A | * | 7/1994 | Iwashita et al. | 261/112.1 |
| 5,585,047 | A | | 12/1996 | Mortensen et al. | |
| 5,683,004 | A | * | 11/1997 | Aho | 211/187 |
| 6,047,663 | A | * | 4/2000 | Moreau et al. | 119/529 |
| 6,098,354 | A | * | 8/2000 | Skandis | 52/177 |
| 6,170,216 | B1 | * | 1/2001 | Rye et al. | 52/660 |
| 6,517,058 | B1 | | 2/2003 | Engh et al. | |
| 6,708,960 | B2 | | 3/2004 | Olson et al. | |
| 6,810,834 | B2 | * | 11/2004 | Hutchings et al. | 119/529 |
| 7,128,310 | B2 | | 10/2006 | Mockry et al. | |
| 7,618,026 | B2 | | 11/2009 | Armstrong | |
| RE41,723 | E | | 9/2010 | Olson et al. | |
| 8,225,566 | B2 | * | 7/2012 | Prevost et al. | 52/302.1 |
| 2005/0277490 | A1 | * | 12/2005 | Allen | 473/415 |
| 2008/0073801 | A1 | | 3/2008 | Beltz et al. | |

* cited by examiner

*Primary Examiner* — Robert Canfield
(74) *Attorney, Agent, or Firm* — R. Keith Harrison

(57) ABSTRACT

A grid panel includes a generally elongated, rectangular main panel section having a plurality of main panel section corners: a pair of generally elongated, rectangular end panel sections extending from the main panel section beyond the main panel section corners, each of the end panel sections having a plurality of end panel section corners; a plurality of grid notches between the main panel section corners and the end panel section corners, respectively; and a plurality of grid openings in the main panel section and each of the end panel sections.

20 Claims, 9 Drawing Sheets

GRID PANEL

FIELD

Illustrative embodiments of the disclosure generally relate to grid panels. More particularly, illustrative embodiments of the disclosure generally relate to a grid panel which is suitable for use as a fill material in a cooling tower and is characterized by enhanced structural stability, efficiency and longevity and low operating and maintenance cost.

BACKGROUND

Industrial cooling towers are extensively used to efficiently dissipate large quantities of heat to the atmosphere in factories, chemical processing plants, hospitals, nuclear power plants and other facilities. Cooling towers commonly include multiple vertical posts on which grid panels are supported in vertically-spaced relationship to each other as a fill material for the tower. Each grid panel includes multiple grid openings through which heated water falls and cool air rises. Therefore, the grid panels provide a surface for exchange of heat from the falling water to the rising air so the cooled water can be used as a cooling medium in an industrial process, air conditioning system or the like.

In cooling tower applications, it may be desirable that the grid panels have large surface areas to maximize exchange of heat from the falling water to the rising air. Moreover, it may be desirable that grid panels have sufficient strength and stability to span large areas with minimal support to maximize the surface area which is available for heat exchange.

Accordingly, a grid panel which is suitable for use as a fill material in a cooling tower and is characterized by enhanced structural stability, efficiency and longevity and low operating and maintenance cost is desirable.

SUMMARY

Illustrative embodiments of the disclosure are generally directed to a grid panel which is suitable for use as a fill material in a cooling tower and is characterized by enhanced structural stability, efficiency and longevity and low operating and maintenance cost. An illustrative embodiment of the grid panel includes a generally elongated, rectangular main panel section having a plurality of main panel section corners; a pair of generally elongated, rectangular end panel sections extending from the main panel section beyond the main panel section corners, each of the end panel sections having a plurality of end panel section corners; a plurality of grid notches between the main panel section corners and the end panel section corners, respectively; and a plurality of grid openings in the main panel section and each of the end panel sections.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable users skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description. As used herein, relative terms such as "upper", "upwardly" and "downwardly" are intended for descriptive purposes only and are not to be construed in a limiting sense.

Figure 19:
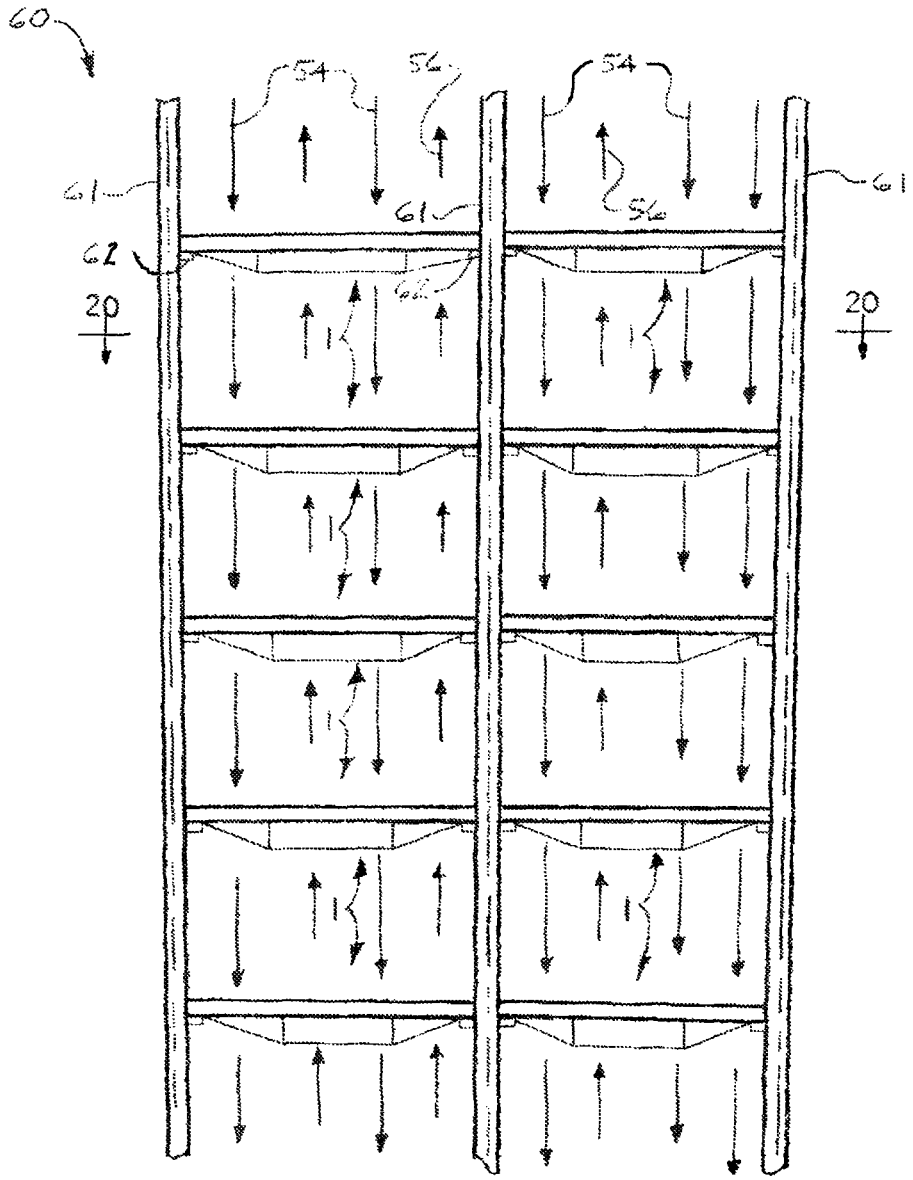
FIG. 19 is a side view, partially in section, of a portion of a cooling tower, with multiple grid panels mounted in vertically-spaced relationship to each other as a fill material in the cooling tower.
Figure 20:
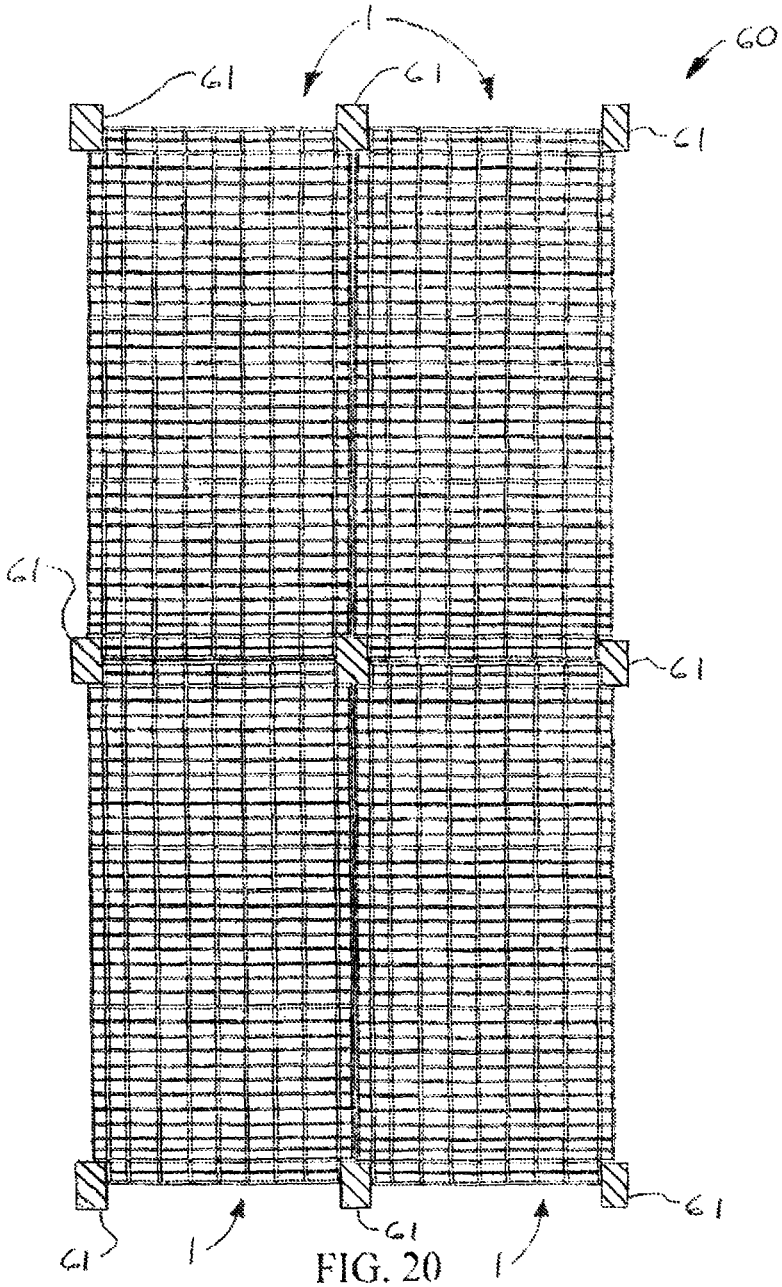
FIG. 20 is a sectional view, taken along section lines 20-20 in FIG. 19.

Referring initially to FIGS. 1-9, 19 and 20 of the drawings, an illustrative embodiment of the grid panel is generally indicated by reference numeral 1. As illustrated in FIGS. 19 and 20 and will be hereinafter further described, multiple grid panels 1 are suitable for use as a fill material in a cooling tower 60 for the purpose of cooling heated water 54 as the heated water 54 falls through the grid panels 1 and heat is transferred from the heated water 54 to air 56 as the air 56 rises through the grid panels 1. The grid panels 1 provide a large surface area for exchange of heat from the water 54 to the air 56 and are characterized by enhanced structural stability, efficiency and longevity and low operating and maintenance cost.

Figure 1:
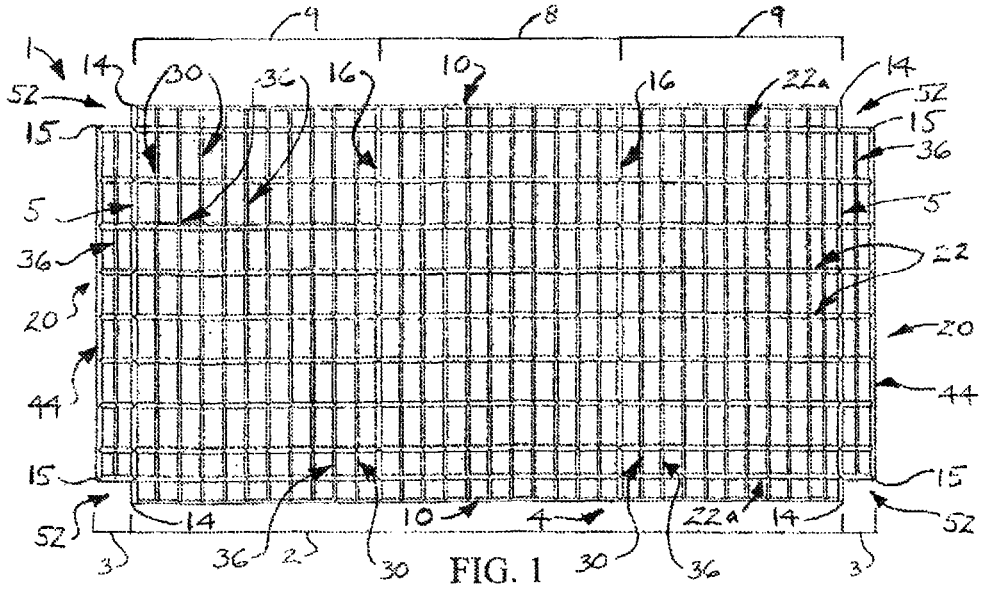
FIG. 1 is a top view of an illustrative embodiment of a grid panel.

The various components of the grid panel 1 may be fabricated in a selected cross-sectional configuration of a suitable plastic material such as polyethylene, polypropylene or nylon or may be steel or other metal or material having a plastic coating. As illustrated in FIG. 1, each grid panel 1 may have a generally elongated and rectangular main panel section 2. A pair of end panel sections 3 may terminate the main panel section 2. Each end panel section 3 may have a width which is less than the width of the main panel section 2. The main panel section 2 includes a main panel section frame 4 which may be generally elongated and rectangular. As illustrated in FIGS. 1 and 6-9, the main panel section frame 4 may include a pair of generally elongated, parallel, spaced-apart end frame members 5. A pair of generally elongated, parallel, spaced-apart side frame members 10 may extend between the end frame members 5. Multiple elongated, parallel, spaced-apart inner longitudinal panel members 22 may extend between the end frame members 5. Multiple elongated, parallel, spaced-apart transverse panel members 30, 36 may extend between the side frame members 10 in intersecting relationship to the inner longitudinal panel members 22.

Each end panel section 3 of the grid panel 1 may include an end panel section frame 20. The end panel section frame 20 may include a terminal panel member 44 which extends between a pair of outermost longitudinal panel members 22*a* and is disposed in spaced-apart, parallel relationship to the end frame member 5 on the corresponding end of the main panel section 2. Each inner longitudinal panel member 22 may extend beyond the end frame member 5 and terminate on the terminal panel member 44. At least one transverse panel member 36 may extend between the outermost longitudinal panel members 22*a* between and parallel to the end frame member 5 and the terminal panel member 44. The main panel section 2 has multiple main panel section corners 14 at the junctions between the end frame members 5 and the side frame members 10. Each end panel section 3 has a pair of end panel section corners 15 at the junctions between the terminal panel members 44 and the outermost longitudinal panel members 22*a*.

A grid notch 52 extends between each main panel section corner 14 and each corresponding end panel section corner 15 of the grid panel 1. Each grid notch 52 may be formed by and between a corresponding end segment of each end frame member 5 and a corresponding end segment of each outermost longitudinal panel member 22*a*.

As further illustrated in FIG. 1, the main panel section 2 of the grid panel 1 may be divided into a middle panel portion 8 and a pair of end panel portions 9 which extend from the middle panel portion 8. A pair of middle panel members 16 may divide the middle panel portion 8 from the end panel portions 9. Each middle panel member 16 may extend between the side frame members 10 in parallel and spaced-apart relationship to the transverse panel members 30, 36. A matrix of grid openings 50 is formed by and between the end frame members 5, the side frame members 10, the middle panel members 16, the inner longitudinal panel members 22, the transverse panel members 30, 36 and the terminal panel members 44.

Figure 3:
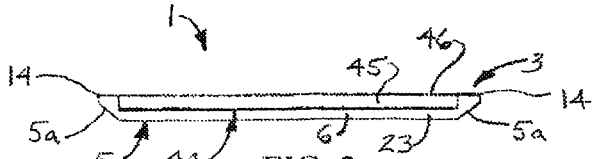
FIG. 3 is a front end view of the illustrative grid panel.
Figure 5:
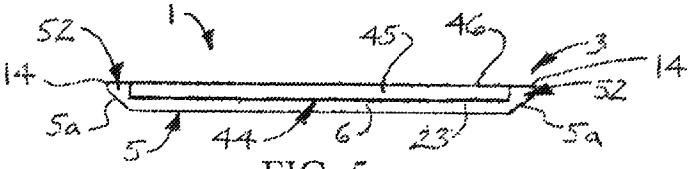
FIG. 5 is a rear end view of the illustrative grid panel.
Figure 12:
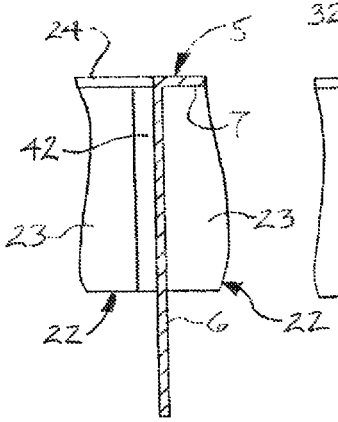
FIG. 12 is a sectional view, taken along section lines 12-12 in FIG. 9.

Referring next to FIGS. 9-15 of the drawings, exemplary cross-sectional shapes or configurations of the end frame members 5, the side frame members 10, the middle panel members 16, the inner longitudinal panel members 22, the transverse panel members 30, 36 and the terminal panel members 44 are shown. As illustrated in FIG. 12, each end frame member 5 of the main panel section 2 may have an end frame member wall 6 and an end frame member flange 7 which extends perpendicularly from and along an upper edge of the end frame member wall 6. As illustrated in FIG. 10A, each side frame member 10 of the main panel section 2 may have a side frame member wall 11 and a side frame member flange 12 which extends perpendicularly from and along the side frame member wall 11. At the respective main panel section corners 14 of the main panel section 2, the end frame member wall 6 of each end frame member 5 may be continuous with the side frame member wall 11 of each side frame member 10 at a 90-degree angle. Likewise, the end frame member flange 7 of each end frame member 5 may be continuous with the side frame member flange 12 of each side frame member 10 at a 90-degree angle. As illustrated in FIGS. 3 and 5, in end view of the grid panel 1, the ends of the end frame member wall 6 of each end frame member 5 may have an end frame member bevel 5*a*.

Figure 2:
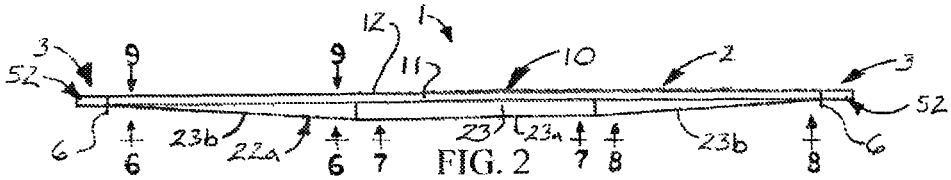
FIG. 2 is a right side view of the illustrative grid panel.
Figure 4:
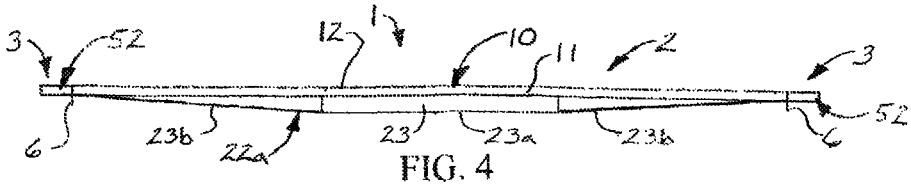
FIG. 4 is a left view of the illustrative grid panel.
Figure 15:
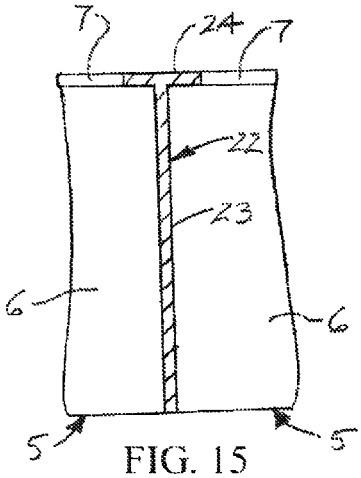
FIG. 15 is a sectional view, taken along section lines 15-15 in FIG. 9.

As illustrated in FIG. 15, in cross-section each inner longitudinal panel member 22 (and each outermost longitudinal panel member 22*a*) may have a longitudinal panel member wall 23 which may be continuous with and perpendicular to the end frame member wall 6 of each end frame member 5 at the respective ends of each inner longitudinal panel member 22. A longitudinal panel member flange 24 may terminate and extend along the upper edge of the longitudinal panel member wall 23 in a T-shaped configuration. The longitudinal panel member flange 24 of each inner longitudinal panel member 22 may be continuous with and perpendicular to the end frame member flange 7 of each end frame member 5. As illustrated in FIGS. 2 and 4, in side view of the grid panel 1, each outermost longitudinal panel member 22*a* (and each inner longitudinal panel member 22) may have a straight edge segment 23*a* and a pair of beveled edge segments 23*b* which taper from opposite ends of the straight edge segment 23*a*.

Figure 13:
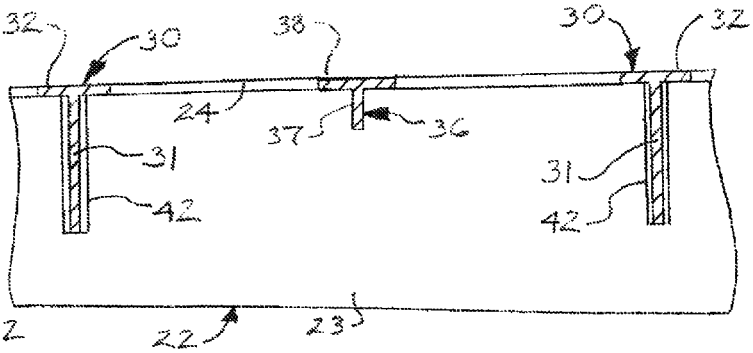
FIG. 13 is a sectional view, taken along section lines 13-13 in FIG. 9.

As illustrated in FIG. 1, the transverse panel members 30 may alternate with the adjacent transverse panel members 36 between and in parallel relationship to the end frame members 5 of the main panel section 2. As illustrated in FIG. 13, in cross-section each transverse panel member 30 may have a transverse panel member wall 31 which may be continuous with and perpendicular to the longitudinal panel member wall 23 of each intersecting inner longitudinal panel member 22 and also continuous with and perpendicular to the side frame member wall 11 of each side frame member 10 at the corresponding end of each transverse panel member 30. A transverse panel member flange 32 may extend along the upper edge of the transverse panel member wall 31 in a T-shaped configuration. The transverse panel member flange 32 may be continuous with the longitudinal panel member flange 24 of each intersecting inner longitudinal panel member 22 and with the side frame member flange 12 of each side frame member 10 at the corresponding end of each transverse panel member 30.

As further illustrated in FIG. 13, each transverse panel member 36 may have a transverse panel member wall 37 which may be continuous with and perpendicular to the longitudinal panel member wall 23 of each intersecting inner longitudinal panel member 22 and continuous with and perpendicular to the side frame member wall 11 of each side frame member 10 at the corresponding end of each transverse panel member 36. A transverse panel member flange 38 may extend along the upper edge of the transverse panel member wall 37 in a T-shaped configuration. The transverse panel member flange 38 may be continuous with and perpendicular to the longitudinal panel member flange 24 of each intersecting inner longitudinal panel member 22 and continuous with and perpendicular to the side frame member flange 12 of each side frame member 10 at the corresponding end of each transverse panel member 36. The transverse panel member wall 37 of each transverse panel member 36 may be substantially shorter than the transverse panel member wall 31 of each adjacent transverse panel member 30.

Figure 14:
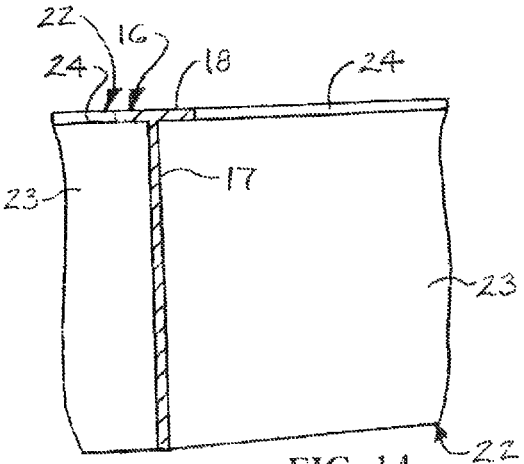
FIG. 14 is a sectional view, taken along section lines 14-14 in FIG. 9.

As illustrated in FIG. 14, in cross-section each middle panel member 16 of the main panel section 2 may have a middle panel member wall 17 which may be continuous with and perpendicular to the longitudinal panel member wall 23 of each intersecting inner longitudinal panel member 22 and continuous with and perpendicular to the side frame member wall 11 of each side frame member 10 at the corresponding end of each transverse panel member 36. A middle panel member flange 18 may extend along the upper edge of the middle panel member wall 17 in a T-shaped configuration. The middle panel member flange 18 of each middle panel member 16 may be continuous with and perpendicular to the longitudinal panel member flange 24 of each intersecting inner longitudinal panel member 22 and continuous with and perpendicular to the side frame member flange 12 of each side frame member 10 at the corresponding end of each middle panel member 16.

Figure 10:
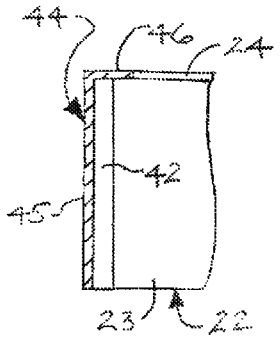
FIG. 10 is a sectional view, taken along section lines 10-10 in FIG. 9.
Figure 10A:
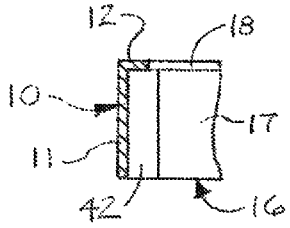
FIG. 10A is a sectional view, taken along section lines 10A-10A in FIG. 9.
Figure 11:
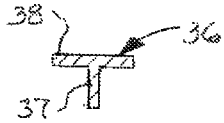
FIG. 11 is a sectional view, taken along section lines 11-11 in FIG. 9.

As illustrated in FIG. 10, in cross-section the terminal panel member 44 of each end panel section 3 may have a terminal panel member wall 45 which is continuous with and perpendicular to the longitudinal panel member wall 23 of each inner longitudinal panel member 22. A terminal panel member flange 46 may extend along the upper edge of the longitudinal panel member wall 45. The terminal panel member flange 46 may be continuous with and perpendicular to the longitudinal panel member flange 24 of each inner longitudinal panel member 22.

Figure 6:
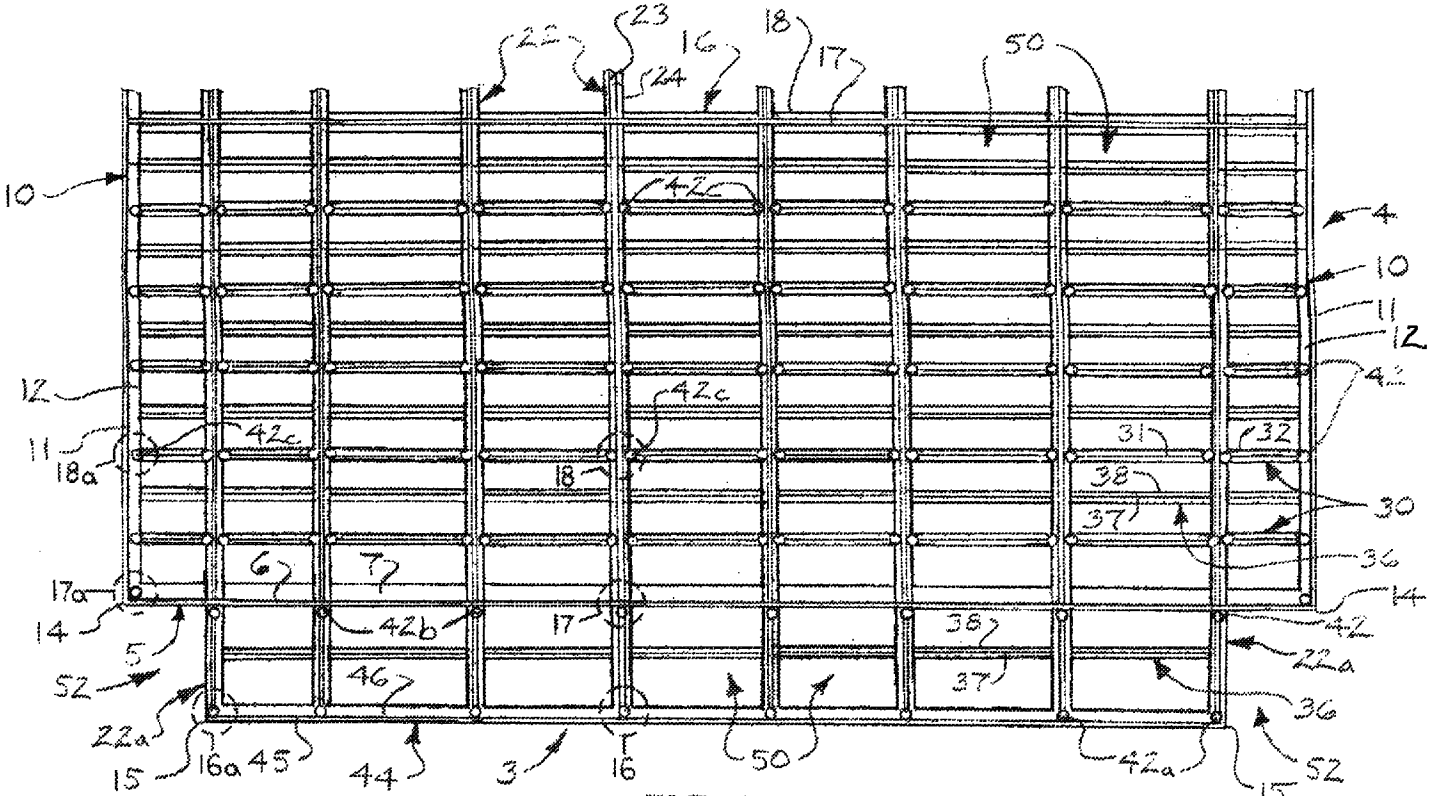
FIG. 6 is a bottom view of an end portion of the illustrative grid panel, taken along viewing lines 6-6 in FIG. 2.
Figure 7:
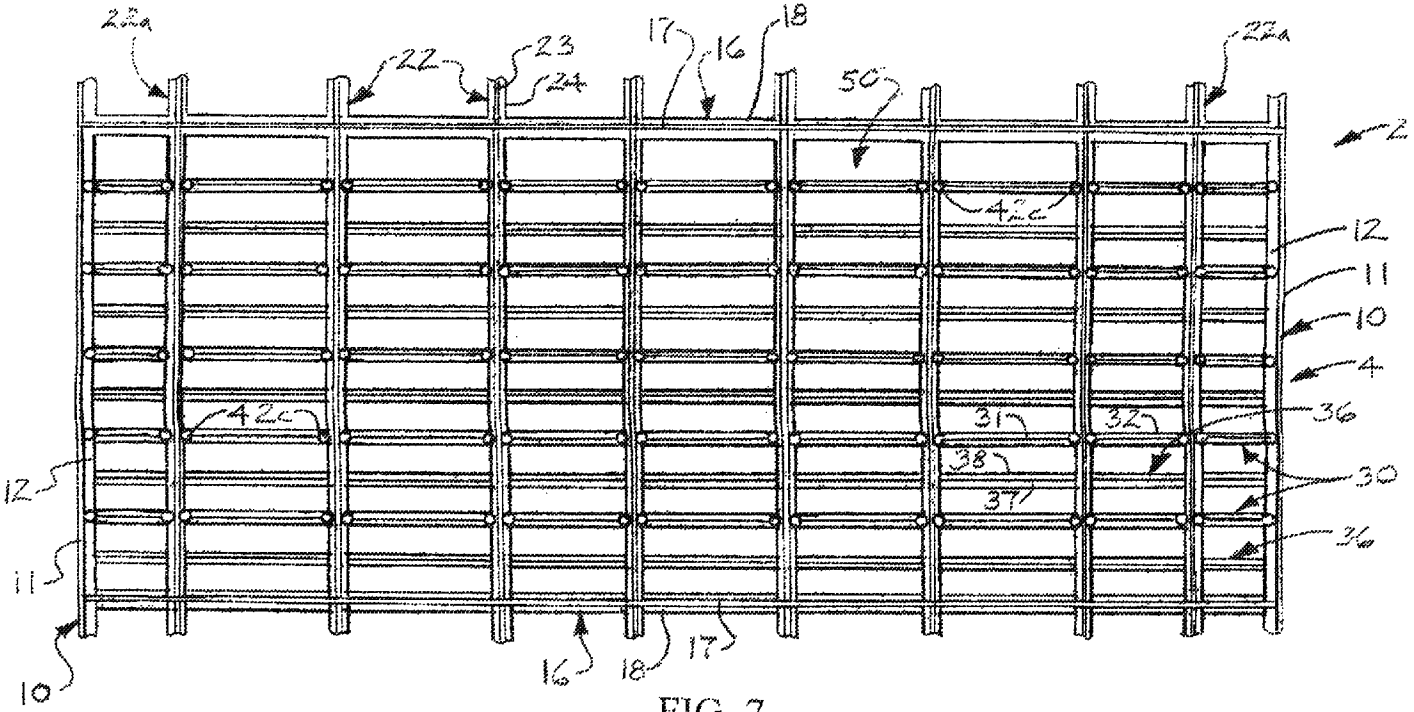
FIG. 7 is a bottom view of a middle portion of the illustrative grid panel, taken along viewing lines 7-7 in FIG. 2.
Figure 8:
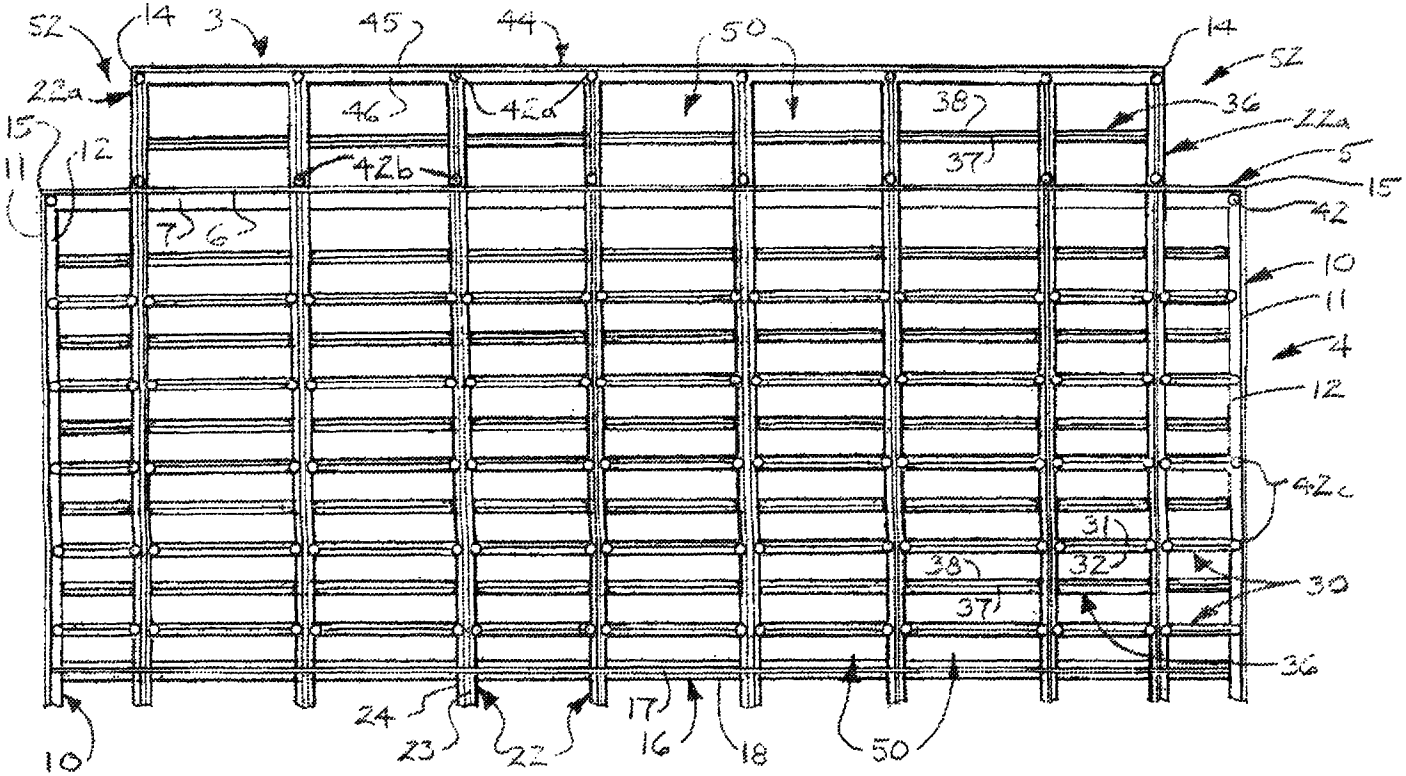
FIG. 8 is a bottom view of an end portion of the illustrative grid panel, taken along viewing lines 8-8 in FIG. 2.
Figure 9:
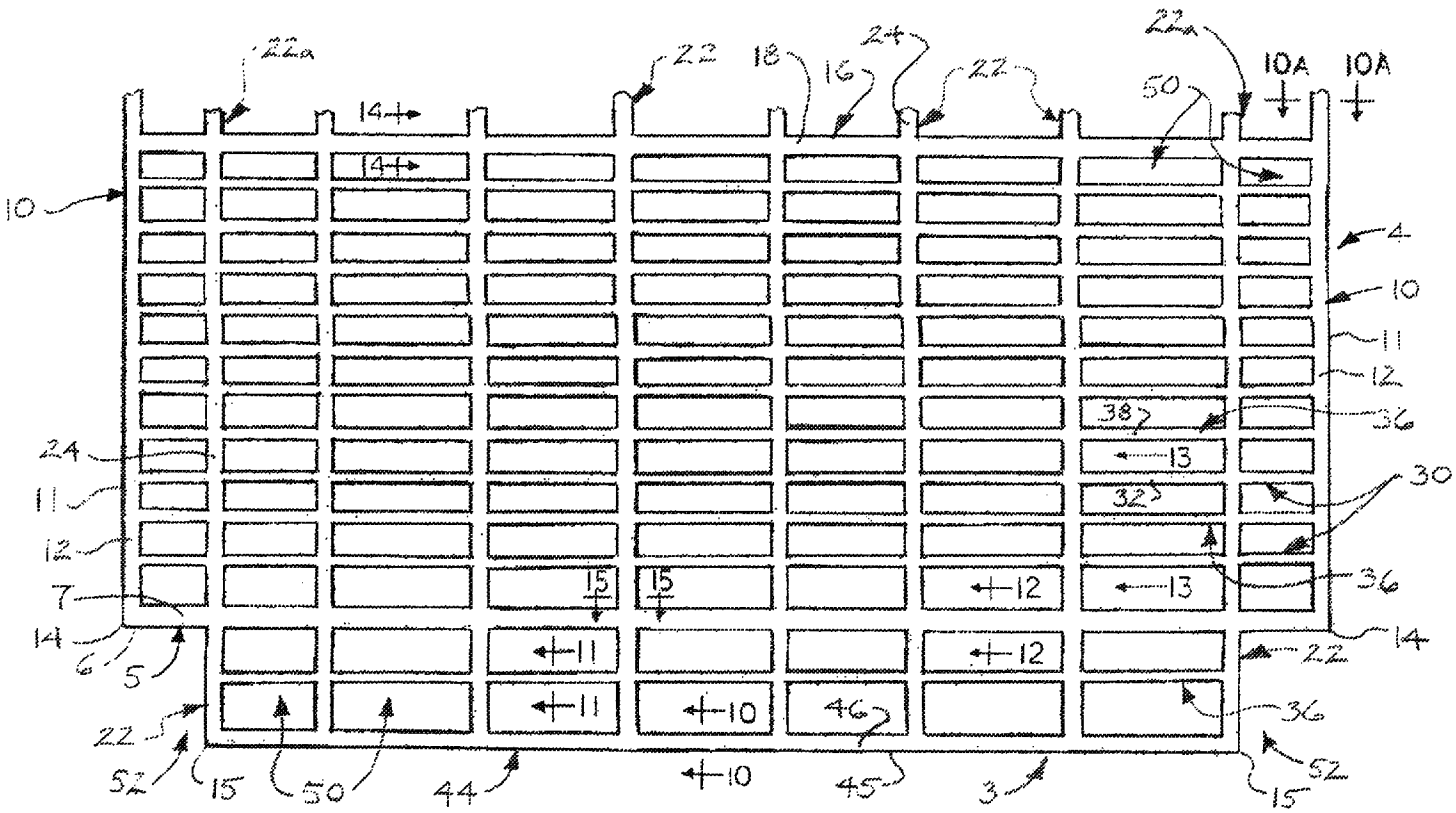
FIG. 9 is a top view of an end portion of the illustrative grid panel, taken along viewing lines 9-9 in FIG. 2.

Referring next to FIGS. 6-8 and 16-18A of the drawings, panel reinforcing columns 42*a-c* may be provided at various locations or positions throughout the grid panel 1 for structural reinforcement purposes. The panel reinforcing columns 42*a-c* may be molded into the grid panel 1 at the junctions between the structural components of the main panel section 2 and the end panel sections 3. For example and without limitation, as illustrated in FIG. 6, a first set of the panel reinforcing columns 42*a* may be provided generally at the junctions between each terminal panel member 44 and the respective inner longitudinal panel members 22 and outermost longitudinal panel members 22*a*. A second set of the panel reinforcing columns 42*b* may be provided generally at the junctions between each end frame member 5 and the respective intersecting inner longitudinal panel members 22. A third set of the panel reinforcing columns 42*c* may be provided generally at the junction between each inner longitudinal panel member 22 and each intersecting transverse panel member 30.

Figure 16:
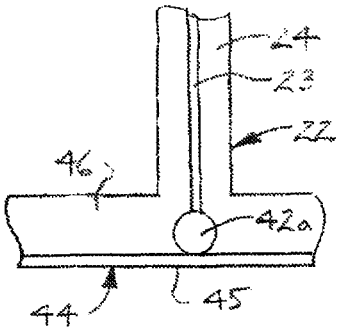
FIG. 16 is an enlarged sectional view, taken along section line 16 in FIG. 6.
Figure 16A:
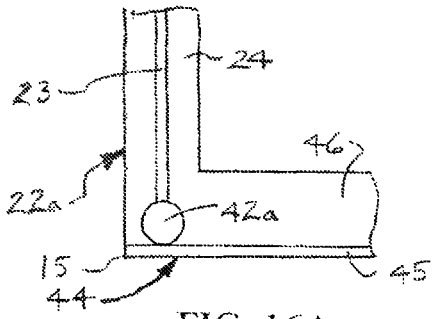
FIG. 16A is an enlarged sectional view, taken along section line 16A in FIG. 6.

As illustrated in FIG. 16, the first set of panel reinforcing columns 42*a* may include a panel reinforcing column 42*a* which extends downwardly from the terminal panel member flange 46 between the terminal panel member wall 45 of the terminal panel member 44 and the end of the longitudinal panel member wall 23 of each corresponding inner longitudinal panel member 22. As illustrated in FIG. 16A, a panel reinforcing column 42*a* may likewise extend downwardly from the terminal panel member flange 46 between the terminal panel member wall 45 of the terminal panel member 44 and the end of the longitudinal panel member wall 23 of each corresponding outermost longitudinal panel member 22*a* at the end panel section corner 15.

Figure 17:
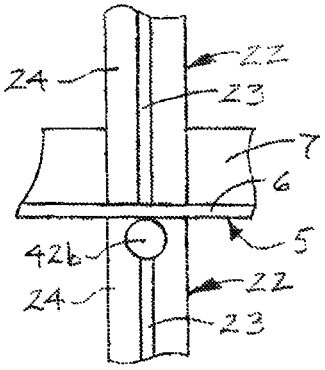
FIG. 17 is an enlarged sectional view, taken along section line 17 in FIG. 6.
Figure 17A:
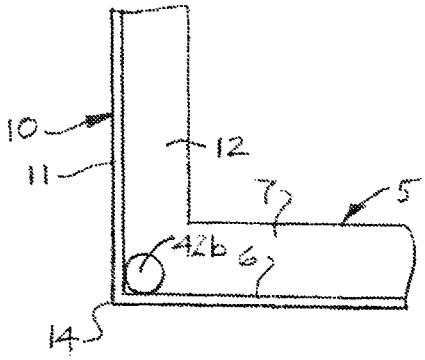
FIG. 17A is an enlarged sectional view, taken along section line 17A in FIG. 6.

As further illustrated in FIG. 6, the second set of panel reinforcing columns 42*b* may include panel reinforcing columns 42*b* which are provided at the respective junctions between the end frame members 5 and the intersecting inner longitudinal panel members 22 and outermost longitudinal panel members 22*a*. Accordingly, as illustrated in FIG. 17, a panel reinforcing column 42*b* may extend downwardly from the longitudinal panel member flange 24 between the end of the longitudinal panel member wall 23 of the inner longitudinal panel member 22 and the end frame member wall 6 of the intersecting end frame member 5. As illustrated in FIG. 17A, a panel reinforcing column 42*b* may likewise extend downwardly from the end frame member flange 7 of the end frame member 5 and the side frame member flange 12 of the side frame member 10 at the junction between the end frame member wall 6 and the side frame member wall 11 at the main panel section corner 14.

Figure 18:
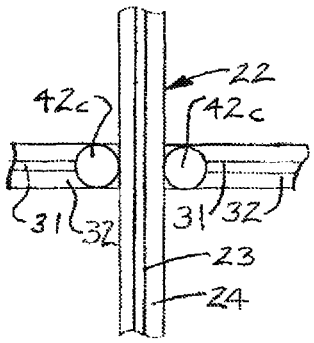
FIG. 18 is an enlarged sectional view, taken along section line 18 in FIG. 6.
Figure 18A:
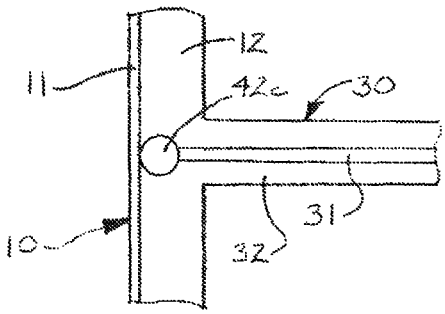
FIG. 18A is an enlarged sectional view, taken along section line 18A in FIG. 6.

As further illustrated in FIG. 6, the third set of panel reinforcing columns 42*c* may include a panel reinforcing column 42*c* provided at the junction between the inner longitudinal panel members 22 and each outermost longitudinal panel members 22*a* and each intersecting transverse panel members 30. Accordingly, as illustrated in FIG. 18, a pair of spaced-apart panel reinforcing columns 42*c* may extend downwardly from the transverse panel member flange 32 of each transverse panel member 30 at each junction between the inner longitudinal panel members 22 and the transverse panel members 30. The inner longitudinal panel member 22 extends between the panel reinforcing columns 42*c*. The longitudinal panel member flange 24 may be molded integrally with the panel reinforcing columns 42*c*. As illustrated in FIG. 18A, a panel reinforcing column 42*c* may likewise extend downwardly from the side frame member flange 12 of each side frame member 10 between the side frame member wall 11 and the terminus of the transverse panel member wall 31 on the transverse panel member 30.

Referring next to FIGS. 19 and 20 of the drawings, in exemplary application multiple grid panels 1 are used as a fill material in a cooling tower 60 to facilitate cooling of heated water 54 as the heated water 54 falls through the grid openings 50 of the grid panels 1. The cooling tower 60 may include multiple vertical grid panel supports 61 which support the grid panels 1 in a horizontal and vertically-spaced orientation. The vertical grid panel supports 61 may be wood, metal, plastic, cement and/or other material which renders the vertical grid panel supports 61 suitable for the purpose. In some applications, the vertical grid panel supports 61 may be 2×6 wooden beams. Horizontal grid panel supports 62 may extend between the adjacent vertical grid panel supports 61 to support the grid panels 1 at a selected height on the vertical grid panel supports 61. The grid panels 1 are typically supported on the horizontal grid panel supports 62 at the end panel sections 3.

As illustrated in FIG. 20, at each level of the cooling tower 60, multiple grid panels 1 may be supported by the vertical grid panel supports 61 and the horizontal grid panel supports 62 in adjacent relationship to each other. The grid notches 52 at the respective corners of each grid panel 1 accommodate a portion of the corresponding grid panel support 61. Therefore, four of the grid panels 1 can be placed in side-by-side relationship to each other with a single vertical grid panel support 61 occupying the four grid notches 52 at the center of the grid panels 1.

In operation of the cooling tower 60, heated water 54 from an industrial or cooling process or the like is fed onto the top of the cooling tower 60 and falls through the grid openings 50 of the grid panels 1. Simultaneously, cool air 56 is blown from the bottom of the cooling tower 60 upwardly through the grid openings 50. As the heated water 54 falls through the cooling tower 60, heat transfers from the heated water 54 to the cooled air 56. Thus, the rising air 56 is progressively heated and is discharged from the top of the cooling tower 60 to the atmosphere as hot air. Conversely, the falling water 54 is progressively cooled and collected in the bottom of the cooling tower 60 as cooled water. The cooled water is continually distributed back through the industrial or cooling process for cooling purposes and then returned to the top of the cooling tower 60 as the heated water 54. As it falls through the grid openings 50, the heated water 54 strikes the surfaces of the grid panels 1 and splashes, forming a film of water on the surfaces. The water film on the surfaces of the grid panels 1 spreads the water out to maximize the surface area which is available for transfer of heat from the heated water 54 to the flowing air 56.

It will be appreciated by those skilled in the art that the surfaces of the end frame members 5, the side frame members 10, the middle panel members 16, the longitudinal panel members 22, 22*a*, the transverse panel members 30, 36 and the terminal panel members 44 provide a large film-forming surface area on which the water film can form for maximal heat exchange between the heated water 54 and the flowing air 56. Moreover, the flanged L-shaped and T-shaped cross-sectional construction of the end frame members 5, the side frame members 10, the middle panel members 16, the longitudinal panel members 22, 22*a*, the transverse panel members 30, 36 and the terminal panel members 44, along with the stabilizing effects of the panel reinforcing columns 42*a*, 42*b* and 42*c*, impart longitudinal, transverse and torsional rigidity to the grid panel 1. This expedient enables support of the grid panels 1 at the end panel sections 2 only without requiring additional structural support at the main panel section 2. Therefore, each grid panel 1 can span a considerable space while utilizing 100% of that space for heat exchange between the heated water 54 and the flowing air 56. Additionally, the grid panels 1 are capable of withstanding ice loads which may have a tendency to form on the grid panels 1 in cold weather. Furthermore, due to the positions of the grid notches 52, the grid panels 1 are easy to install and remove on the grid panel supports 61 for replacement and/or maintenance purposes.

While illustrative embodiments of the disclosure have been described above, it will be recognized and understood that various modifications can be made and the appended claims are intended to cover all such modifications which may fall within the spirit and scope of the disclosure.

What is claimed is:

1. A grid panel, comprising:

a generally elongated, rectangular main panel section having a plurality of main panel section corners, the main panel section having a plurality of intersecting panel members including a plurality of generally elongated, parallel, spaced-apart longitudinal panel members;

a pair of generally elongated, rectangular end panel sections extending from the main panel section beyond the main panel section corners, each of the end panel sections having a plurality of end panel section corners;

each of the longitudinal panel members having a straight edge segment parallel to a longitudinal axis of the grid panel and extending along and coextensive with the main panel section and a pair of beveled edge segments each oppositely extending from the straight edge segment to a respective end panel section;

a plurality of grid openings in the main panel section and each of the end panel sections; and a plurality of panel reinforcing columns at junctions between the plurality of intersecting panel members of the main panel section.

2. The grid panel of claim 1 wherein the main panel section comprises a main panel section frame and a matrix of the intersecting panel members is carried by the main panel section frame, and wherein the end panel sections are carried by the main panel section frame.

3. The grid panel of claim 2 wherein the main panel section frame comprises a pair of generally elongated, parallel, spaced-apart end frame members and a pair of generally elongated, parallel, spaced-apart side frame members extending between the end frame members, and wherein the matrix of intersecting panel members is carried by the end frame members and the side frame members.

4. The grid panel of claim 3 wherein the matrix of intersecting panel members comprises the plurality of generally elongated, parallel, spaced-apart longitudinal panel members extending between the end frame members of the main panel section frame and a pair of generally elongated, parallel, spaced-apart transverse panel members extending between the side frame members of the main panel section frame and intersecting the longitudinal panel members.

5. The grid panel of claim 4 wherein each of the end frame members of the main panel section frame comprises an end frame member wall and an end frame member flange extending along the end frame member wall in a T-shaped cross-sectional configuration.

6. The grid panel of claim 4 wherein each of the side frame members of the main panel section frame comprises a side frame member wall and a side frame member flange extending along the side frame member wall in an inverted L-shaped cross-section.

7. The grid panel of claim 4 wherein each of the longitudinal panel members comprises a longitudinal panel member wall and a longitudinal panel member flange extending along the longitudinal panel member wall in a T-shaped cross-section.

8. The grid panel of claim 4 wherein each of the transverse panel members comprises a transverse panel member wall and a transverse panel member flange extending along the transverse panel member wall in a T'-shaped cross-section.

9. A grid panel, comprising:

a generally elongated, rectangular main panel section including:

a main panel section frame having a plurality of main panel section corners;

a matrix of intersecting panel members carried by the main panel section frame, the panel members including a plurality of generally elongated, parallel, spaced-apart longitudinal panel members; and a plurality of panel reinforcing columns at junctions between the plurality of intersecting panel members of the main panel section;

a pair of generally elongated, rectangular end panel sections each including:

an end panel section frame extending from the main panel section frame of the main panel section and having a plurality of end panel section corners; and a matrix of intersecting panel members carried by the end panel section frame;

each of the longitudinal panel members having a straight edge segment parallel to a longitudinal axis of the grid panel and extending along and coextensive with the main panel section and a pair of beveled edge segments each oppositely extending from the straight edge segment to a respective end panel section;

a plurality of grid notches between the main panel section corners of the main panel section frame and the end panel section corners of the end panel sections, respectively; and a plurality of grid openings formed by and between the intersecting panel members of the main panel section and the intersecting panel members of each end panel section.

10. The grid panel of claim 9 wherein the main panel section frame comprises a pair of generally elongated, parallel, spaced-apart end frame members and a pair of generally elongated, parallel, spaced-apart side frame members extending between the end frame members, and wherein the matrix of intersecting panel members of the main panel section is carried by the end frame members and the side frame members.

11. The grid panel of claim 10 wherein the matrix of intersecting panel members of the main panel section comprises the plurality of generally elongated, parallel, spaced-apart longitudinal panel members extending between the end frame members of the main panel section frame and a pair of generally elongated, parallel, spaced-apart transverse panel members extending between the side frame members of the main panel section frame and intersecting the longitudinal panel members.

12. The grid panel of claim 11 wherein the end panel section frame comprises a pair of outermost longitudinal panel members extending from a corresponding one of the end frame members of the main panel section frame of the main panel section and a terminal panel member carried by the outermost longitudinal panel members, and wherein the matrix of intersecting panel members of each end panel section comprises a plurality of generally elongated, parallel, spaced-apart inner longitudinal panel members extending between the corresponding one of the end frame members and the terminal panel member and at least one transverse panel member extending between the outermost longitudinal panel members and intersecting the longitudinal panel members.

13. The grid panel of claim 11 wherein each of the end frame members of the main panel section frame comprises an end frame member wall and an end frame member flange extending along the end frame member wall in a T-shaped cross-sectional configuration.

14. The grid panel of claim 11 wherein each of the side frame members of the main panel section frame comprises a side frame member wall and a side frame member flange extending along the side frame member wall in an inverted L-shaped cross-section.

15. The grid panel of claim 11 wherein each of the longitudinal panel members comprises a longitudinal panel member wall and a longitudinal panel member flange extending along the longitudinal panel member wall in a T-shaped cross-section.

16. The grid panel of claim 11 wherein each of the transverse panel members comprises a transverse panel member wall and a transverse panel member flange extending along the transverse panel member wall in a T-shaped cross-section.

17. A grid panel, comprising:

a generally elongated, rectangular main panel section including:

a generally elongated, rectangular main panel section frame having:

a pair of generally elongated, parallel, spaced-apart end frame members;

a pair of generally elongated, parallel, spaced-apart side frame members extending between the end frame members;

a plurality of generally elongated, parallel, spaced-apart longitudinal panel members carried by the end frame members:

a plurality of generally elongated, parallel, spaced-apart transverse panel members carried by the side frame members and intersecting the longitudinal panel members;

a plurality of main panel section corners at junctions between the end frame members and the side frame members:

a plurality of grid openings formed by and between the longitudinal panel members and the transverse panel members; and a plurality of panel reinforcing columns at junctions between the end frame members and the side frame members, between the longitudinal panel members and the end frame members and between the transverse panel members and the side frame members, respectively, and at intersections between the longitudinal panel members and the transverse panel members, respectively;

a pair of generally elongated, rectangular end panel sections each including:

an end panel section frame having:

a pair of outermost longitudinal panel members extending from a corresponding one of the end frame members of the main panel section frame of the main panel section;

a terminal panel member carried by the outermost longitudinal panel members:

a plurality of generally elongated, parallel, spaced-apart longitudinal panel members extending between the corresponding one of the end frame members and the terminal panel member;

at least one transverse panel member extending between the outermost longitudinal panel members and intersecting the longitudinal panel members;

a plurality of grid openings formed by and between the longitudinal panel members and the at least one transverse panel member of the end panel section; and a plurality of grid openings formed by and between the longitudinal panel members and the at least one transverse panel member of each end panel section; and a plurality of panel reinforcing columns at junctions between the corresponding one of the end frame members and the outermost longitudinal panel members and between the terminal panel member and the longitudinal panel members, and at intersections between the corresponding one of the end frame members and the outermost longitudinal panel members; and grid notches between the main panel section corners of the main panel section frame and the end panel section corners of the end panel sections, respectively.

18. The grid panel of claim 17 wherein each of the end frame members of the main panel section frame comprises an end frame member wall and an end frame member flange extending along the end frame member wall in a T-shaped cross-sectional configuration, and each of the side frame members of the main panel section frame comprises a side frame member wall and a side frame member flange extending along the side frame member wall in an inverted L-shaped cross-section.

19. The grid panel of claim 18 wherein each of the longitudinal panel members comprises a longitudinal panel member wall and a longitudinal panel member flange extending along the longitudinal panel member wall in a T-shaped cross-section.

20. The grid panel of claim 19 wherein each of the transverse panel members comprises a transverse panel member wall and a transverse panel member flange extending along the transverse panel member wall in a T-shaped cross-section.

* * * * *